US005694879A

United States Patent [19]

Taylor

[11] Patent Number: 5,694,879

[45] Date of Patent: Dec. 9, 1997

[54] BOAT DOCKING APPARATUS

[76] Inventor: James Taylor, 2526 W. Swallow Rd., Springfield, Mo. 65810

[21] Appl. No.: 691,960

[22] Filed: Aug. 5, 1996

[51] Int. Cl.[6] ..... B63B 21/00

[52] U.S. Cl. ..... 114/230; 267/74

[58] Field of Search ..... 114/221 R, 230, 114/213–215; 267/69–74; 119/786, 769, 789, 797, 798

[56] References Cited

U.S. PATENT DOCUMENTS

| | | | |
|---|---|---|---|
| 2,593,940 | 4/1952 | Van Meter | 267/74 |
| 2,912,953 | 11/1959 | Olsen | 114/230 |
| 3,139,852 | 7/1964 | Morris | 114/230 |
| 3,817,507 | 6/1974 | Derman et al. | 267/74 |
| 3,863,591 | 2/1975 | Wild | 114/230 |
| 4,817,551 | 4/1989 | Matson | 114/230 |
| 4,917,039 | 4/1990 | Siero | 114/230 |
| 4,955,309 | 9/1990 | Ciccone | 114/230 |
| 5,307,753 | 5/1994 | Besonen, Sr. et al. | 114/230 |
| 5,482,258 | 1/1996 | Clauson | 114/230 |

*Primary Examiner*—Edwin L. Swinehart

*Attorney, Agent, or Firm*—William Patrick Waters

[57] ABSTRACT

A mooring apparatus having an elongated tubular housing wherein the housing is adapted for positioning between a boat and a dock while providing positive control in two directions. A pin for fixing an elongated helical spring within the housing is disposed adjacent the dock engaging end thereof. An end cap, including a pair of spaced apart cable guiding apertures, is provided at the dock end of the housing. A cable, for engagement of a dock stanchion or piling, is looped through the end cap apertures and around the pin for slideable movement thereabout. A second cable, looped through a pair of guiding apertures in an end cap at the boat end of the housing, engages the elongated spring at the end opposite the fixed end, the second cable being adapted for attachment to a boat cleat. Bumpers, fixed at each end of the elongated housing help pad points of contact between boat, dock and apparatus, thereby substantially reducing shock to the inner housing of the apparatus. In operation, the combination of spring, cables and cable guiding end caps cooperate to dampen sudden boat movements and, even under extreme conditions, to transfer loads away from the spring and cables by achieving a slow load transfer, thereby stabilizing the boat and preventing damage to boat and dock.

13 Claims, 2 Drawing Sheets

BOAT DOCKING APPARATUS

FIELD OF THE INVENTION

The present invention relates in general to docking and mooring systems and, more particularly, to a docking apparatus for boats.

BACKGROUND ART

Various boat docking devices are known and they range in complexity from a simple line to complicated and expensive systems. Many docking systems are useful under ordinary conditions when there is little wave action and the wind is not gusting. However, it has been long recognized that it is no easy task to fix a boat to a dock so that both can emerge from a dynamic and sometimes violent encounter with wave and wind without damage.

Some boat docking devices are disclosed in U.S. Pat. Nos. 3,139,852; 3,817,507; 4,817,551; 4,917,039 and 4,955,309. The devices disclosed in these patents function satisfactorily in some cases. However, under conditions of violent wave action, or under the influence of gusting winds, these devices can fail to protect the tethered boat from damage. In some cases, use of such conventional devices under adverse weather conditions can result in damage to both boat and dock. This problem can be exacerbated when, at least in some cases, the device has sharp edges or hooks which can damage the boat. Thus, it is apparent that a need exists for a boat docking apparatus that can protect both boat and dock, even under conditions of violent wave action or high winds.

U.S. Pat. No. 2,912,953 discloses a mooring device for small boats. It includes a spring which is attached to a dock and to a boat, at opposite ends thereof. The spring allows controlled vertical movement of the boat. While such control has merit, it does not prevent boat damage from wave or wind forces which move the boat violently in a three dimensional environment. U.S. Pat. No. 4,864,956 discloses a device for mooring a boat which includes a coil spring having clevises connected to and projecting from the spring. An unwieldy combination of springs, clevises and cables acts to attach a boat at two points to a dock. Different devices are required in order to moor the boat.

U.S. Pat. No. 5,307,753 discloses a water motion device having a spring within a housing for absorbing shock and water motion. The primary utility of the invention appears only to be stabilization along the longitudinal axis of the spring. Similarly, U.S. Pat. No. 5,482,258 discloses a boat mooring line having a helical coil spring held by retention plates, within a tubular housing. A first cable, having a loop projecting from one end of the housing, is journalled through the longitudinal axis of the spring and is fixed to one of the retention plates. A second cable is similarly disposed at the opposite end of the housing and is fixed to the other retention plate. This invention appears to be expensive and complicated. In addition, it is limited primarily, also, to stabilization along the longitudinal axis of the spring.

In view of the foregoing, it is apparent that the inventions disclosed in the aforementioned patents have limited utility for stabilizing a boat rocking in a violent wave or pitching and rolling in a gusting wind. Indeed, the patents discussed above reveal a recognition of a need for a docking apparatus which can moor a boat to a dock in a secure and stable manner, and for maintaining stability under adverse environmental conditions. It is conceded that in some cases, conventional devices can achieve the objective of securing the boat in a mooring. However, this can be at the cost of damage to boat and dock surfaces when the boat is moved abruptly by the dynamic action of wave or wind. In such cases, structural and cosmetic damage to boats utilizing such conventional devices can be substantial.

In view of the foregoing, it is fair to state that the inventions disclosed in the above mentioned patents have some utility. However, they are generally lacking in an ability to hold a boat securely, without damage to the boat, at a set distance from a dock, while the boat rises and falls on swells or is buffeted by winds. Thus, it would be highly desirable to have a boat docking apparatus which could secure a boat to a dock while preventing unwanted contact between the boat and the dock under violent wave and wind conditions.

Ideally, such an apparatus would be constructed of readily available materials, would be inexpensive to manufacture and would be convenient to use.

DISCLOSURE OF INVENTION

It is an object of the present invention to provide a boat docking apparatus which is capable of holding securely a boat against a dock, without damage to either boat or dock, under conditions of extreme wind and wave activity.

It is a further object of the present invention to provide a technique for mooring a boat in a double slip and preventing contact between the two during violent wave and wind activity.

It is another object of the present invention to provide a boat docking apparatus which is constructed of readily obtainable materials and is inexpensive to manufacture.

It is a further object of the present invention to provide a boat docking apparatus which can be easily stored aboard a boat and which is convenient to use.

Briefly, the above and further objects of the present invention are realized by providing a mooring apparatus having an elongated tubular housing wherein the housing is adapted for positioning between a boat and a dock while providing positive control in two directions. A pin for fixing an elongated helical spring within the housing is disposed adjacent the dock engaging end thereof. An end cap, including a pair of spaced apart cable guiding apertures, is provided at the dock end of the housing. A cable, for engagement of a dock stanchion or piling, is looped through the end cap apertures and around the pin for slideable movement thereabout. A second cable, looped through a pair of guiding apertures in an end cap at the boat end of the housing, engages the elongated spring at the end opposite the fixed end, the second cable being adapted for attachment to a boat cleat. Bumpers, fixed at each end of the elongated housing help pad points of contact between boat, dock and apparatus, thereby substantially reducing shock to the inner housing of the apparatus. In operation, the combination of spring, cables and cable guiding end caps cooperate to dampen sudden boat movements and, even under extreme conditions, to transfer loads away from the spring and cables by achieving a slow load transfer, thereby stabilizing the boat and preventing damage to boat and dock.

The apparatus of the present invention affords several advantages by virtue of the fact that it effectively stabilizes the boat while substantially reducing the distance the boat can move in relation to the dock while, at the same time, providing freedom of movement of the boat under influence of wave or wind. The novel spring and cable combination, in which the spring is fixed at one end within the housing, keeps the apparatus in tension, thereby eliminating slack. This technique serves to substantially reduce, and in many cases to eliminate, damage to either boat or dock by collisions between the two. In addition, this novel feature permits boats to be docked relatively close to one another without concern for damaging collisions between them and it also can allow docking one boat with another. An additional advantage is that the apparatus is convenient to use and is constructed of inexpensive and readily available materials.

BRIEF DESCRIPTION OF DRAWINGS

The above mentioned and other objects and features of this invention and the manner of attaining them will become apparent and the invention itself will be best understood by reference to the following description of the embodiment of the invention in conjunction with the accompanying drawings, wherein.

BEST MODE FOR CARRYING OUT THE INVENTION

Figure 1:
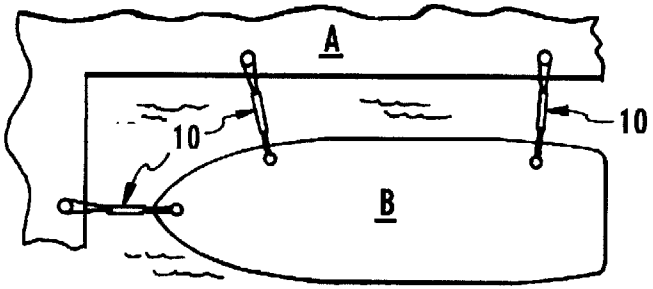
FIG. 1 illustrates one way to use the docking apparatus of the present invention to secure a boat to a dock.

A preferred embodiment of the boat docking apparatus will now be summarized, before a more detailed explanation of the drawings is presented. The present invention presents a novel approach to an old problem. It is intended for use especially in holding a boat in a desired position by attaching at three points on the boat and the novel apparatus substantially reduces concerns about damage when docking in a double slip alongside another boat.

The apparatus of the present invention includes an elongated housing which, for convenience, will sometimes be described herein as having a "dock end" and a "boat end". The apparatus comprises an elongated tubular housing enclosing a spring fixed at the dock end inside the housing while the other end of the spring can be drawn, against resistance, toward the boat end. Two cables, one for attachment to a dock and the other for attachment to a boat, are utilized. The cable for the dock is looped around a pin fixing the spring inside the housing. The cable enters and leaves the housing through an entry aperture, and an exit aperture, respectively, which are disposed in a spaced apart relationship in a housing end cap. This cable can be fixed to a dock stanchion or post in a novel manner, as more fully discussed below.

An end cap, similar to that fixed at the opposite end of the housing, is fixed at the boat end. It also contains a pair of spaced apart apertures. A second cable, adapted for attachment to a boat cleat, passes through the apertures. The free ends of the second cable, after entering the housing through the respective apertures, are joined together by a ferrule which is set in an offset portion of the spring. Within the housing, the cable portions held together by the ferrule, form two legs of an acute angle having the ferrule at the apex.

In use, the spring, cables, housing and housing end cap apertures cooperate to contain motion away from the dock and to dampen any effects of wave or wind action, thereby preventing damage to boat and dock. In the majority of applications, the boat end cable loop can extend for about 7 inches from the end cap, without any danger of overextending the spring. This enables the apparatus to be used with most of the cleats on modem boats.

When a boat, moored with the present invention, is exposed to violent wind or wave action, the cable at the dock end holds the apparatus fast against the dock while the boat end cable pulls the spring with the boat. As this occurs, the cable legs are drawn through the two spaced apart apertures in the end cap. As the force pulling on the cable increases and the cable and attached spring are pulled with the boat, the angle formed by the two cable legs flattens out as the spring is drawn closer to the spaced apart apertures in the end cap. As this occurs, the changing angle accomplishes a dynamic load transfer from the spring to the housing and end cap. As a result, there is no sudden shock as the cable loop is pulled out to its limit. Instead, a slow transfer takes place thereby dampening any effect from a violent pull on the spring. Once the extreme load is removed, the cable loop is pulled back by the spring and normal cushioning resumes. In accomplishing its function, the novel design of the apparatus maintains constant the distance from the end of the spring to the boat. As the boat moves away from the dock, for example, the spring moves with it.

The elongated housing of the present invention, in addition to containing the elements discussed above, serves other useful purposes. By wrapping it in a foam sleeve, protection of boat and dock surfaces is provided and the apparatus will float because of the foam. The boat end of the housing includes a non-marking spherical pad covering the end cap. This novel pad effectively protects the boat from scratches and dents and, together with the housing, acts to absorb motion without boat damage. This accommodates the changing angles between the boat and the dock as the spring keeps a constant tension on the boat cleat.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope With reference now to the drawings, in which identical structural elements in the several figures are designated by identical reference characters, there is shown in FIG. 1 one way to use the present invention in which an apparatus 10 is depicted as attaching a boat B to a dock A. While one technique of mooring a boat is shown, it will be readily apparent to one skilled in the art that the apparatus 10 can be utilized in other mooring configurations.

Figure 3:
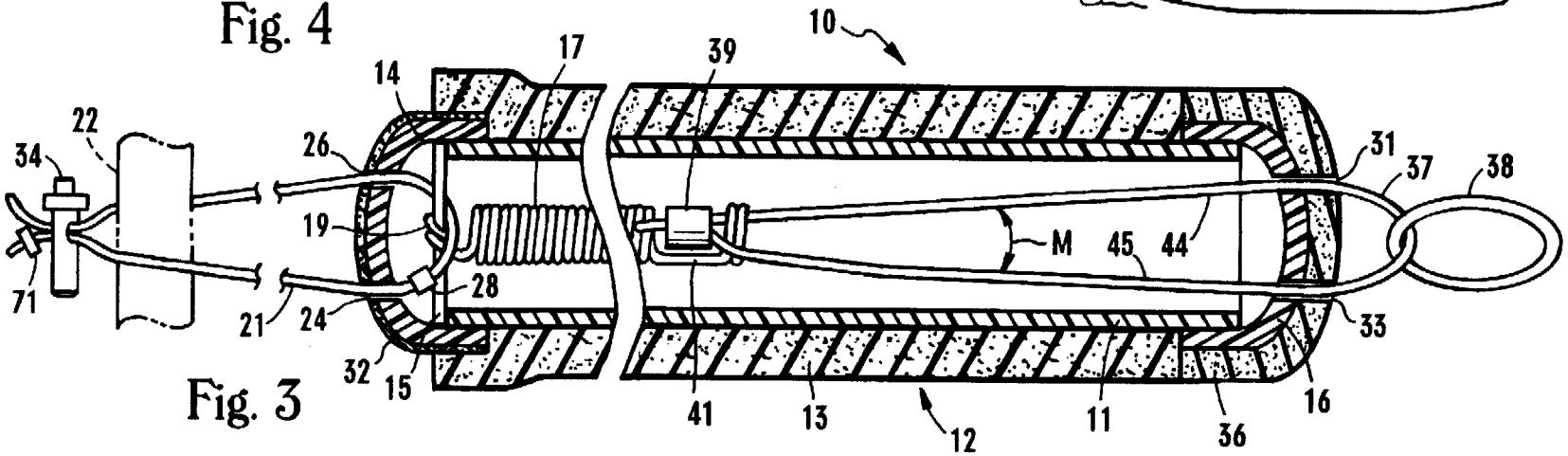
FIG. 3 is a sectional view of the docking apparatus taken along the line 3—3 of FIG. 2.
Figure 2:
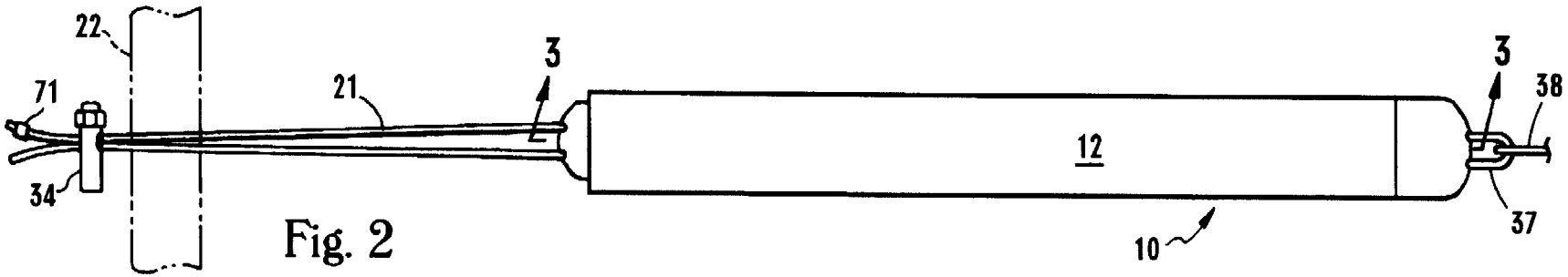
FIG. 2 is an orthographic view of the docking apparatus of the present invention.

In FIGS. 2 and 3, there is shown an orthographic view of the apparatus 10 in which there is provided an elongated tubular housing 12 which, for convenience of description will be described as having a "dock end" (appearing on the left as the figures are viewed) and a "boat end" located at the end of the housing 12 opposite the dock end. The housing 12 is comprised of a rigid tube 11, preferably of PVC which is covered by a protective vinyl nitrile sponge sheath 13.

An end cap 14 is fixed to the tube 11 at the dock end of the housing 12 while another end cap 16 is fixed to the tube 11 at the boat end thereof. Preferably, the end caps 14 and 16 are of rigid PVC composition. In order to protect the dock and the apparatus 10 from damage, the end cap 14 is covered with a bonded vinyl cap 32 having a thickness of about 0.09 inches. In addition, the end cap 16 has bonded to it a Neoprene foam cap 36 to provide cushioning protection to the boat and to the apparatus 10.

A rolled steel pin 15 is fixed within the housing 12 against the dock end of the tube 11. In a preferred embodiment, the pin 15 is of mild steel composition having a length between 1 and 2 inches and, in a preferred embodiment, a length of about 1.6 inches. A diameter of about 0.125 inches is suitable. An elongated helical spring 17 is disposed coaxially within the housing 12. The spring 17 includes a loop 19 which holds one end of the spring to the pin 15.

A cable 21 is used to secure the apparatus 10 to a dock attachment, such as a stanchion 22.

The end cap 14 includes a pair of spaced openings 24 and 26 which preferably are about 0.38 inches apart. As shown in FIG. 3, the cable 21 enters the housing 12 by passing through the opening 24. The cable 21 then loops around the pin 15 and exits the housing 12 through the opening 26. A stop 28 on the cable 21 prevents separation of the cable from the housing 12.

In use, the cable 21 is looped around the stanchion 22 and is held securely in place by a clamp 34. The cooperation between the clamp 34 and the cable 21 in holding the apparatus 10 against the stanchion 22 will be more fully discussed below. It will, of course, be recognized by those skilled in the art of boat mooring devices that in use, the end cap 14 would be drawn up in close proximity to the stanchion 22.

Considering now the boat end of the apparatus 10, with further reference to FIGS. 2 and 3, the end cap 16 includes a pair of openings 31 and 33, also preferably spaced apart by a distance of about 0.38 inch. A second cable 37, similar in composition to the cable 21, loops through a snap ring 38 and enters the housing 12 through the openings 31 and 33. It will be recognized that the snap ring 38 is useful for engaging a bow ring or other conventional mooring device (not shown) on a boat to be docked. The free ends of the cable 37 are joined together by a ferrule 39. The ferrule 39 is nested in an offset portion 41 in the spring 17. With the ferrule 39 so fixed, unwanted rotation of the cable 37 is prevented during operation of the apparatus 10.

It is recognized, of course, that the cable 37 is one continuous length. However, for purposes of illustration, the cable 37 may be regarded as having a pair of legs 44 and 45 extending away from the spring 17. The leg 39 exits the end cap 16 through the opening 31 while the leg 41 passes through the opening 33 in the end cap 16.

The condition of the spring 17 and the cable 37, as shown in FIG. 3, is that which generally obtains when the apparatus 10 is in use securing a boat to a dock and small loads are placed on the apparatus 10. Under such conditions, the legs 44 and 45 of the cable 37 form an acute angle M having the ferrule 39 at the apex of the angle. Under conditions of gentle wave action, or mild gusts of wind, the load on the pin 15 remains relatively constant and a portion of the load is transferred dynamically to the cable 21 fixed to the dock. At the same time, the spring 17 lengthens and shortens, thereby dampening any shock to boat or dock. Of course, it should be understood that, as the spring 37 moves toward or away from the end cap 16, the magnitude of the angle M changes.

Figure 3A:
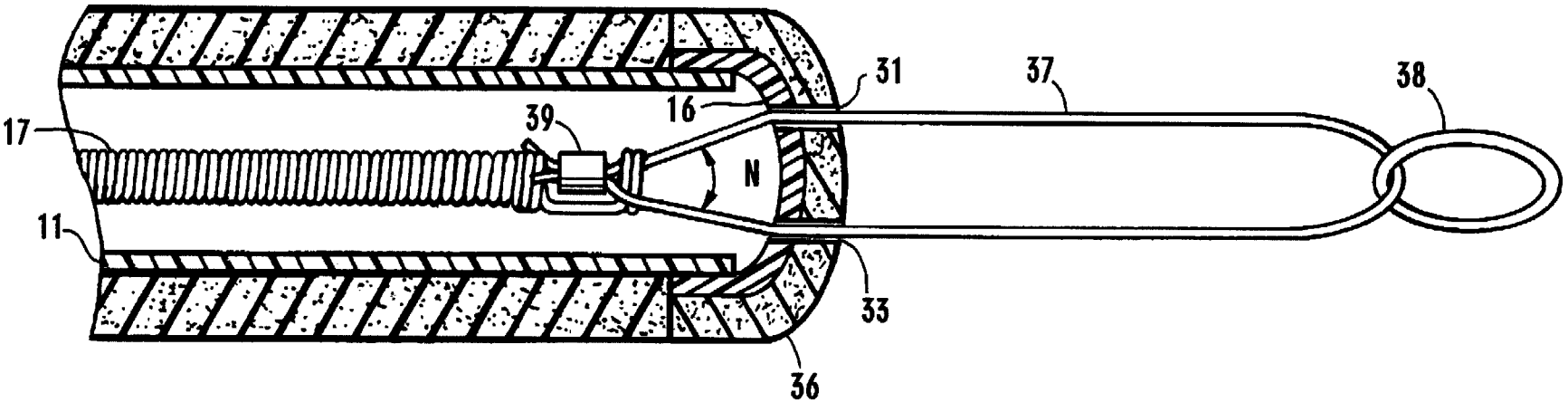
FIG. 3A is a view of a portion of the docking apparatus of FIG. 3 showing the spring of FIG. 3 in an extended condition.

Conventional boat mooring devices perform satisfactorily when environmental conditions are relatively calm and little stress is placed on the device. However, under conditions of extreme wind and wave conditions, such conventional devices can fall, with damage to boat and dock a result. In some cases, the boat is lost. FIG. 3A depicts what happens inside the apparatus 10 during extreme boat movement.

As extreme boat movement occurs, the spring 17 is stretched in the direction of the boat and, as the stretching takes place, part of the load is shifted, via the openings 31 and 33, to the tube 11. This action helps to dampen the effects of any abrupt boat motion. Importantly, while these events are occurring, tension generated by the moving boat draws the legs 44 and 45 through the openings 31 and 33, respectively. Since the openings 31 and 33 are fixed in the end cap 16, the angle M shown in FIG. 3 becomes less acute, forming an angle N as shown in FIG. 3A, as the spring 17 lengthens. As the angle formed by the legs 44 and 45 flattens out (going from M to N) further dynamic load transfer between the spring and cable combination and the tube 11 takes place. Any load transferred to the tube 11 during an extreme condition is subsequently transferred by the pin 15 back to the cable 21 and finally to the dock.

The novel load transferring characteristics of the apparatus 10 have been demonstrated to stabilize a boat fixed to a dock, even under extreme wind and wave conditions.

Figure 4:
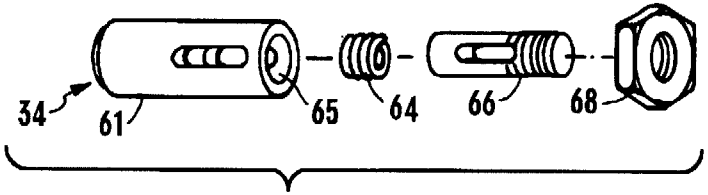
FIG. 4 is a fragmentary view of the spring loaded clamp of the present invention.

With reference now to FIG. 4, a novel cable clamp 34 is shown. It is comprised of a cylinder 61 which is closed at one end. A passageway 65, through the body of the cylinder 61 is provided. A spring 64 is located in the cylinder 61, and a threaded rod 66 for movement in the cylinder 61 to compress the spring 64 is provided. A nut 68 engages the rod 66 and rotation of the nut pulls the rod 66 from the cylinder 61 thereby clamping the cable 21 inside the passageway 65. In use of the apparatus 10, the free ends of the cable 21 are passed through the passageway 65 and are held tightly therewithin when the nut 68 is used to pull the rod 66 against the cable 21 inside the passageway 65. To prevent separation of the cable 21 from the clamp 34, a stop 71, which is larger than the diameter of the passageway 65, is located near one of the free ends of the cable 21.

It will be evident that there are additional embodiments and applications which are not disclosed in the detailed description but which clearly fall within the scope and spirit of the present invention. The specification is, therefore, intended not to be limiting, and the scope of the invention is to be limited only by the following claims.

What is claimed is:

1. An apparatus for securing a boat to a dock, the dock having means for attaching a boat thereto, the apparatus comprising:

an elongated housing, said housing being adapted for positioning between a boat to be docked and the dock attachment means, said housing having spring fixing means disposed therewithin;

an elongated helical spring disposed within said housing, said spring being fixed by said fixing means within said housing;

first cable means, said first cable means being disposed around said spring fixing means for slideable movement thereabout, said first cable means being adapted for releasable engagement of said dock attachment means; and second cable means, said second cable means being fixed to said elongated spring at its end opposite said fixing means, said second cable means having means for attachment to a boat.

2. The apparatus according to claim 1 wherein a first end cap is attached to said housing, at one end thereof, said first end cap including load transferring means.

3. The apparatus according to claim 2 wherein said first end cap load transferring means includes a pair of spaced apart apertures for slideable movement of said first cable means therethrough.

4. The apparatus according to claim 2 wherein said spring fixing means is located adjacent one end of said elongated housing, said spring fixing means being covered by said first end cap.

5. The apparatus according to claim 2, including means for preventing said first cable means from separating from said first end cap.

6. The apparatus according to claim 1 wherein said second cable means includes a pair of leg portions and leg portion joining means, wherein said leg portions are joined together, by said joining means, within said tubular housing.

7. The apparatus according to claim 6 wherein said spring means includes an offset portion for receipt therewithin of said leg joining means.

8. The apparatus according to claim 6 wherein said joining means is a ferrule.

9. The apparatus according to claim 1 wherein said housing further includes a second end cap, said second end cap having a location at the end of said housing opposite that of said first end cap.

10. The apparatus according to claim 9 wherein said second end cap includes load transferring means.

11. The apparatus according to claim 10 wherein said second end cap load transferring means includes a pair of spaced apart apertures for slideable movement of said second cable means therethrough.

12. The apparatus according to claim 11 wherein said second cable leg portions form an angle having said leg portion joining means disposed adjacent the base of said angle, said leg portions extending away from said base with one leg portion passing through one of said pair of second end cap apertures and the other one of said leg portions passing through the other one of said pair of second end cap apertures to form a loop outside of said housing whereby a load tending to pull said loop away from said housing draws said base toward said second end cap apertures, thereby widening said angle.

13. The apparatus according to claim 1 including bumper means, said bumper means being fixed at each end of said elongated housing, said bumper means helping to hold the boat away from the dock.

* * * * *